US009397407B2

(12) United States Patent
Merlet et al.

(10) Patent No.: US 9,397,407 B2
(45) Date of Patent: Jul. 19, 2016

(54) ANTENNA SYSTEM

(71) Applicant: CANON KABUSHIKI KAISHA, Tokyo (JP)

(72) Inventors: Hervé Merlet, Servon sur Vilaine (FR); Pierre Visa, Rennes (FR); Olivier Lafond, Gosne (FR); Mohammed Himdi, Rennes (FR); Jonathan Bor, Rennes (FR)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 14/132,874

(22) Filed: Dec. 18, 2013

(65) Prior Publication Data

US 2014/0176377 A1 Jun. 26, 2014

(30) Foreign Application Priority Data

Dec. 20, 2012 (GB) ..... 1223096.7
Oct. 4, 2013 (GB) ..... 1317616.9

(51) Int. Cl.

| | |
|---|---|
| ***H01Q 15/08*** | (2006.01) |
| ***H01Q 15/10*** | (2006.01) |
| *H01Q 19/06* | (2006.01) |
| *H01Q 21/00* | (2006.01) |

(52) U.S. Cl.

CPC ..... *H01Q 15/10* (2013.01); *H01Q 19/06* (2013.01); *H01Q 19/062* (2013.01); *H01Q 21/0031* (2013.01)

(58) Field of Classification Search

CPC ..... H01Q 15/10; H01Q 19/06; H01Q 19/062; H01Q 21/0031

See application file for complete search history.

(56) References Cited

U.S. PATENT DOCUMENTS

| | | | | |
|---|---|---|---|---|
| 3,680,123 | A | 7/1972 | Bryant et al. | |
| 4,348,678 | A | 9/1982 | Thomas | |
| 4,488,156 | A | 12/1984 | DuFort et al. | |
| 6,366,245 | B1 * | 4/2002 | Schmidt | H01Q 19/062 343/700 MS |
| 2007/0195004 | A1 * | 8/2007 | Rebeiz | H01Q 19/06 343/876 |

FOREIGN PATENT DOCUMENTS

| | | | |
|---|---|---|---|
| CN | 201450116 | U | 5/2010 |
| CN | 102255145 | A | 11/2011 |
| GB | 0655315 | A | 7/1951 |
| GB | 1573481 | A | 8/1980 |
| WO | 01/28162 | A1 | 4/2001 |
| WO | 2005/094352 | A2 | 10/2005 |
| WO | 2006/031341 | A2 | 3/2006 |
| WO | 2006/075437 | A1 | 7/2006 |

* cited by examiner

*Primary Examiner* — Hoang V Nguyen
*Assistant Examiner* — Michael Bouizza
(74) *Attorney, Agent, or Firm* — Canon USA Inc. IP Division

(57) ABSTRACT

An antenna system having a cylindrical electromagnetic lens configured to guide at least one electromagnetic signal to an emerging area by means of at least a variation in dielectric permittivity, thereby generating a beam output from the emerging area. The antenna system has a dielectric member configured to receive the beam output from the emerging area and to focus the beam in an elevation plane perpendicular to a planar face of the cylindrical electromagnetic lens. The cylindrical electromagnetic lens is received in a conductive mounting, and the mounting carries the dielectric member.

30 Claims, 11 Drawing Sheets

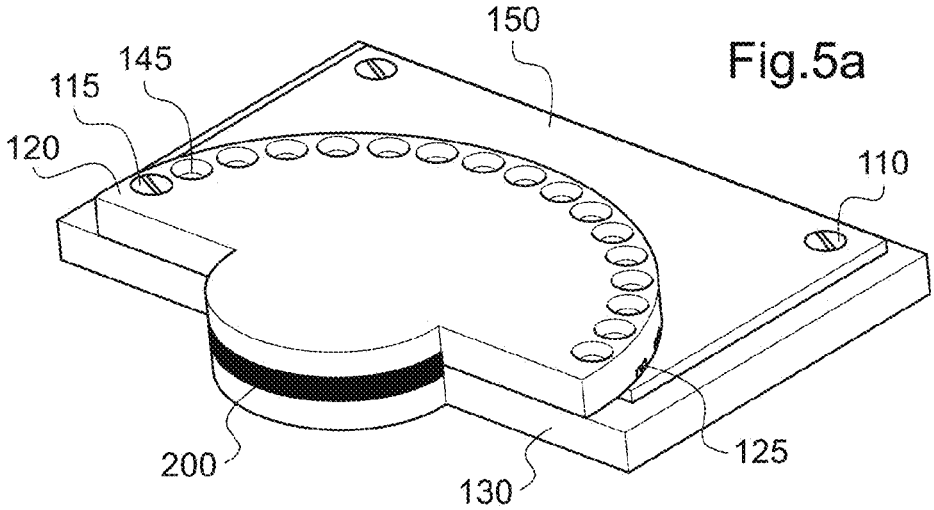
Fig.5a
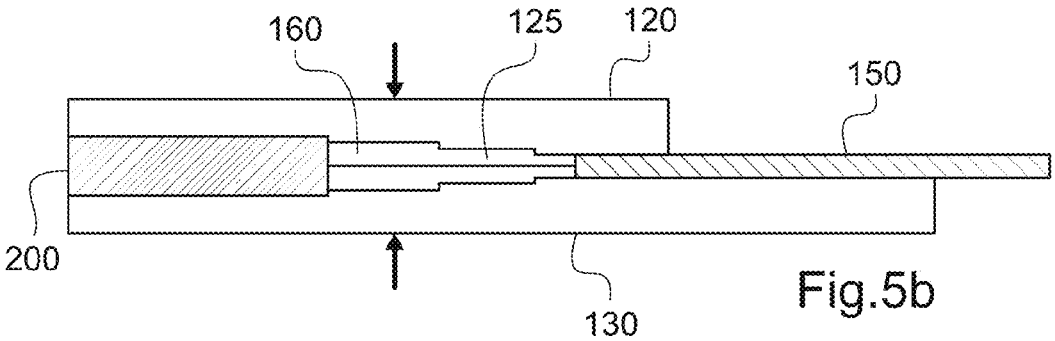
Fig.5b
Fig.6
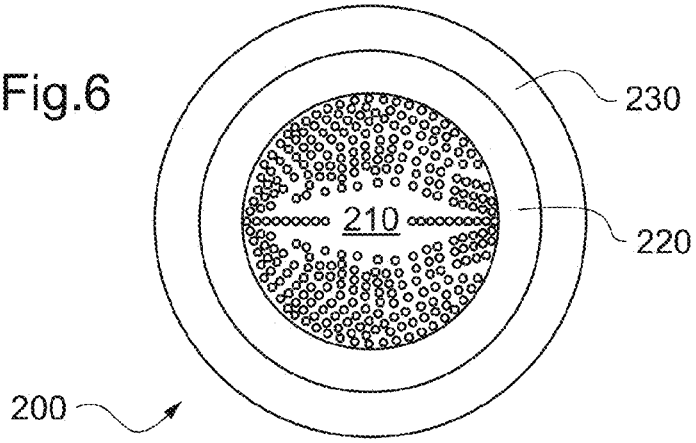

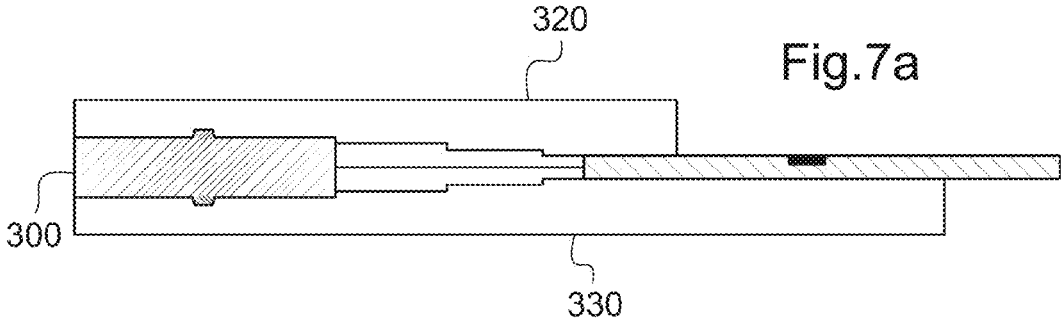
Fig.7a
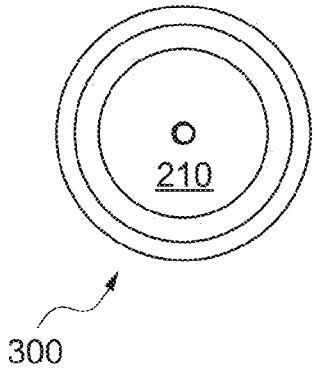
Fig.7b
Fig.8a
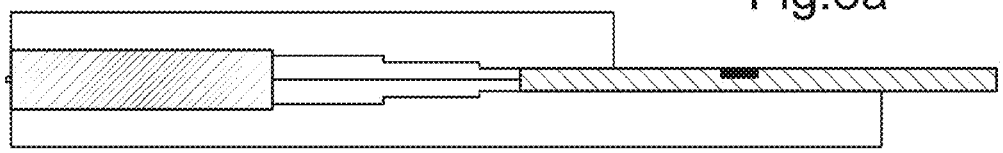
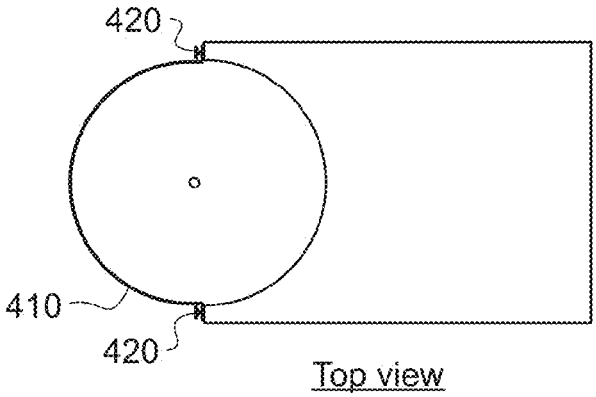
Fig.8b

ANTENNA SYSTEM

This application claims the benefit of Great Britain Patent Application No. 1223096.7 filed Dec. 20, 2012 and Great Britain Patent Application No. 1317616.9 filed Oct. 4, 2013, which are hereby incorporated by reference herein in their entireties.

FIELD OF THE INVENTION

The invention relates to antenna systems, more specifically millimetre wave devices aiming at providing indoor or outdoor wireless transmission.

BACKGROUND OF THE INVENTION

The principle of spherical electromagnetic lenses having a gradient of decreasing refractive index was introduced in 1964 by Rudolf Luneburg in *Mathematical Theory of Optics*, Cambridge University Press. The dielectric constant of the lens, now known as Luneburg lens, is such that $\in_r=2-(r/R)^2$, where $\in_r$ is the relative dielectric constant, r the position considered along the radius, and R is the radius of the lens. Obviously in this case, the dielectric permittivity shall vary from 1 to 2.

With such a lens an incoming front wave is focused at the edge of the lens, on a point opposite to the normal of the incident front wave. Using this property in the opposite direction, illuminating the lens along its edge with a selected one of several thin beams generates an emerging front wave and the selection of a particular thin beam thus allows a good control of the azimuth radiation.

Two techniques have been used for the realization of the lens: drilling, as described for instance in the article "*A Sliced Spherical Lüneburg Lens*", by S. Rondineau, M. Himdi, J. Sorieux, in IEEE Antennas Wireless Propagat. Lett., 2 (2003), 163-166, or use of variable dielectric materials, such as concentric shells, as described in patent application WO 2007/003653.

These prior art solutions with spherical shapes are however not adapted to cases where the angle of radiation in elevation and the capability of beam steering in azimuth are sought.

Solutions exist that use cylindrical lenses. Such lenses are easy to feed with a known 2D electronic circuit. The width of the output beam from such lenses in the elevation plane depends on the cylindrical lenses aperture.

In particular, an antenna system comprising such a cylindrical lens has generally a gain G equal to $$G = \frac{32000}{\theta_A \theta_E},$$

where $\theta_E$ and $\theta_A$ are respectively the beam width angle in elevation and azimuthal planes.

Depending on the aperture of the cylindrical lens, such an antenna system can allow either a mid-range with wide angle communications or a long-range with narrow angle communications.

However, this may not be adapted to a situation wherein different devices to reach are located at both mid-range and long-range distances from the antenna system.

Consequently, there is a need to provide an improved solution allowing performing both types of communications with the same antenna system, thus ensuring a good flexibility of transmission distance.

SUMMARY OF THE INVENTION

In this context, the invention provides an antenna system comprising:

- a cylindrical electromagnetic lens adapted to guide at least one electromagnetic signal to an emerging area by means of at least a variation in dielectric permittivity, thereby generating a beam output from the emerging area;
- a dielectric member adapted to receive the beam output from the emerging area and to focus the beam in an elevation plane perpendicular to a planar face of the cylindrical electromagnetic lens.

The cylindrical electromagnetic lens makes it possible to transform a spherical wave electromagnetic signal, received from a source located on the circumference of the cylindrical lens, into a narrow beam in azimuth (i.e. in a plane perpendicular to the axis of the cylindrical lens). The dielectric member improves the directivity in the elevation plane in order to obtain as a result a concentrated beam in both azimuth and elevation.

The dielectric member has for instance a ring shape and may surround at least partially the cylindrical electromagnetic lens. Precisely, the dielectric member may have a first external surface defined by a first cylinder having a first radius and a second external surface defined by a second cylinder having a second radius smaller than the first radius. In the example given below, the dielectric member is formed as a superstrate.

This shape is particularly suited to cooperate with the cylindrical lens. In particular, the second external surface may then face a (cylindrical) lateral face (e.g. including the emerging area) of the cylindrical electromagnetic lens.

Preferably, the dielectric member cross section has a rectangular shape. The rectangular cross section allows internal reflection and recombination of the electromagnetic waves. Thus, a good focusing effect can be obtained in the elevation plane, while keeping rather small dimensions.

According to the embodiment proposed here, the dielectric member has a height, in a direction parallel to the axis of the cylindrical lens, larger than a thickness of the cylindrical lens in said direction. Thus, despite the rather broad radiation pattern of the cylindrical lens in elevation, rays output from the cylindrical lens are received on the second external surface of the dielectric member, enter the dielectric member and are concentrated in the elevation plane by reflections inside the dielectric member, thereby obtaining the focusing effect mentioned above.

The dielectric member is for instance made of a material having a relative permittivity between 1.5 and 2.5. The dielectric member may be made of PTFE. Such materials make it possible to obtain the focussing effect just described.

According to embodiments described below, the antenna system includes at least one radiating element situated on the circumference of the cylindrical electromagnetic lens and generating said electromagnetic signal.

The radiating element may include at least one waveguide, as well as for instance a feeding circuit generating the electromagnetic signal into the waveguide. The waveguide is generally used to transmit the electromagnetic signal to the cylindrical lens, where it is guided as mentioned above.

According to the possible implementation given below, the cylindrical electromagnetic lens is received in a conductive mounting. The radiating element just mentioned may then be included in said conductive mounting.

The feeding circuit mentioned above, which feeds the radiating element, is for instance also mounted on the conductive mounting. The circuit feeding the radiating element may also at least partly be integrated in a substrate.

The mounting may then also carry the dielectric member.

According to a proposed implementation, the dielectric member may be detachably mounted in the antenna system such that it is possible to add or remove the superstrate depending on whether or not the antenna gain should be increased.

For instance, the beam output from the dielectric member has, in an azimuthal plane perpendicular to the axis of the cylindrical electromagnetic lens, an angular width substantially equal to the angular width of the beam output from the cylindrical electromagnetic lens. In practice, this angular width in azimuth is for instance below 10 °.

Considering the beam output from the cylindrical electromagnetic lens has a first angular width in the elevation plane (e.g. an angular width of 60° or more), the beam output from the dielectric member may then have a second angular width, smaller than the first angular width, in the elevation plane. The second angular width may thus be below 60°, for instance below 30°.

As conventional, the angular width is defined as the difference between angles for which the power is 3 dB below the peak power.

An antenna system as just described may for instance be used for wireless data transmission at about 60 GHz, for instance in the frequency band between 57 GHz and 64 GHz.

In addition, although the antenna system is defined and described here in the case where it is used as a radiating device, it can also be used as a receiving antenna system (receiving device) in view of the reciprocity principle.

Also, the dielectric member may have a variable height in a direction parallel to the axis of the cylindrical electromagnetic lens.

The cylindrical electromagnetic lens makes it possible to transform a spherical wave electromagnetic signal, received from a source located on the circumference of the cylindrical lens, into a narrow beam in azimuth (i.e. in a plane perpendicular to the axis of the cylindrical lens). The dielectric member improves the directivity in the elevation plane in order to obtain as a result a concentrated beam in both azimuth and elevation.

In addition, the variable height of the dielectric member provides a good flexibility so that several different elevation angles can be obtained with the same antenna system.

The dielectric member has for instance a ring shape with a variable height and may surround at least partially the cylindrical electromagnetic lens.

Precisely, the dielectric member extends over at least a half circle arc in the azimuthal plane of the cylindrical electromagnetic lens, with the center of said circle being the center of the cylindrical electromagnetic lens.

In the example given below, the dielectric member is formed as a superstrate.

This shape is particularly suited to cooperate with the cylindrical lens. In particular, the half circle arc may then face a (cylindrical) lateral face (e.g. including the emerging area) of the cylindrical electromagnetic lens.

The dielectric member is for instance made of a material having a relative permittivity between 1.5 and 2.5. The dielectric member may be made at least partly of PTFE. Such materials make it possible to obtain the focussing effect just described.

The dielectric member may comprise at least two parts having different permittivity values.

For example, the parts may be layers that are concentric around the symmetry axis of the lens. The parts may also be sections of the dielectric member.

The parts may comprise different materials, each material having a different permittivity.

In a variant, the parts of different permittivity values may be of the same material with different distributions of (air) holes. The permittivity of each part is thus different given the different distribution of the holes within the material.

The distributions of holes may differ in terms of density of holes within the part, or spacing between the holes, or diameter of the holes.

These features of the dielectric member allow an improved directivity in the elevation plane.

According to embodiments described below, the antenna system includes at least one radiating element situated on the circumference of the cylindrical electromagnetic lens and generating said electromagnetic signal.

The radiating element may include at least one waveguide, as well as for instance a feeding circuit generating the electromagnetic signal into the waveguide. The waveguide is generally used to transmit the electromagnetic signal to the cylindrical lens, where it is guided as mentioned above.

According to the possible implementation given below, the cylindrical electromagnetic lens is received in a conductive mounting. The radiating element just mentioned may then be included in said conductive mounting.

The feeding circuit mentioned above, which feeds the radiating element, is for instance also mounted on the conductive mounting. The circuit feeding the radiating element may also at least partly be integrated in a substrate.

The mounting may then also carry the dielectric member.

According to a proposed implementation, the dielectric member may be detachably mounted in the antenna system such that it is possible to add or remove the superstrate depending on whether or not the antenna gain should be increased.

For instance, the beam output from the dielectric member has, in an azimuthal plane perpendicular to the axis of the cylindrical electromagnetic lens, an angular width substantially equal to the angular width of the beam output from the cylindrical electromagnetic lens. In practice, this angular width in azimuth is for instance below 10°.

Considering the beam output from the cylindrical electromagnetic lens has a first angular width in the elevation plane (e.g. an angular width of 60° or more), the beam output from the dielectric member may then have a second angular width, smaller than the first angular width, in the elevation plane. The second angular width may thus be below 60°, for instance below 30°.

As conventional, the angular width is defined as the difference between angles for which the power is 3 dB below the peak power.

According to implementations, the second angular width in the elevation plane may depend on the angular direction of the beam input in the azimuthal plane of the cylindrical electromagnetic lens.

In other terms, two incoming beams of two different angular directions in the azimuthal plane may lead to output beams having two different angular widths in the elevation plane.

According to implementations, the dielectric member may comprise at least two symmetrical portions which are symmetrical with respect to an elevation plane comprising the axis of the cylindrical electromagnetic lens.

For instance, the elevation plane may cut the dielectric member and the electromagnetic lens respectively into two equal portions.

According to implementations, the dielectric member may comprise at least two portions which are not symmetrical with respect to an elevation plane comprising the axis of the cylindrical electromagnetic lens.

According to implementations, the variation in height of the dielectric member may be continuous along the edges.

Thus, the elevation beam width may continuously vary along the dielectric member.

According to implementations, the dielectric member may comprise at least two portions, each having a different constant height.

According to implementations, the dielectric member may comprise a central portion surrounded by two edges portions.

For example, the edge portions may have the same height, which is different from the height of the central portion.

According to implementations, the variation in height of the dielectric member may be discontinuous along the edges.

According to implementations, the variation in height of the dielectric member may be continuous along the edges of a portion of the dielectric member and discontinuous along the edges of the remaining portion.

According to implementations, the dielectric member may be adjustable around the axis of the cylindrical electromagnetic lens.

Thus, when a targeted device is moved in the room, the dielectric member of the antenna system may be easily moved accordingly.

An antenna system as aforementioned may for instance be used for wireless data transmission at about 60 GHz, for instance in the frequency band between 57 GHz and 64 GHz.

In addition, although the antenna system is defined and described here in the case where it is used as a radiating device, it can also be used as a receiving antenna system (receiving device) in view of the reciprocity principle.

There is also provided a system comprising:

an antenna system as aforementioned, and at least two communication devices each able to communicate with this antenna system.

According to implementations, the dielectric member of the antenna system may comprise as many portions as the number of communication devices.

For example, at least two of these portions may have different heights.

According to implementations, the height of each portion may depend on the distance between the antenna system and the targeted communication device.

In particular, the more a targeted communication device is far, the more the output beam need to be narrow, and the more the corresponding portion of the dielectric member has to be low.

BRIEF DESCRIPTION OF THE DRAWINGS

Other particularities and advantages of the invention will also emerge from the following description, illustrated by the accompanying drawings, in which:

FIG. 5*a* represents a possible embodiment for an assembly including an electromagnetic lens and an electromagnetically shielding member encapsulating the electromagnetic lens partially;

FIG. 5*b* illustrates a cross-section of the embodiment shown in FIG. 5*a;*

FIG. 6 illustrates a possible implementation of the electromagnetic lens;

FIG. 7*a* represents another possible embodiment for an electromagnetic lens and enclosure body;

FIG. 7*b* is a top view of the electromagnetic lens used in FIG. 7*a;*

FIG. 8*a* illustrates a further variation of the electromagnetic lens assembly;

FIG. 8*b* is a top view of the assembly of FIG. 8*a;*

DETAILED DESCRIPTION OF EMBODIMENTS OF THE INVENTION

Figure 1A:
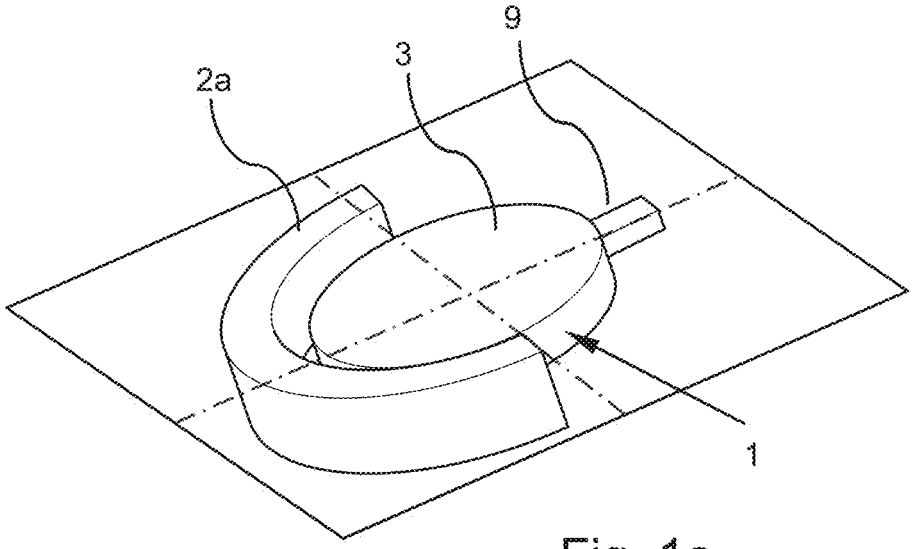
FIG. 1*a* shows an antenna system according to a possible embodiment of the invention.

FIG. 1*a* shows an antenna system, here used as a radiating device, designed according to the teachings of the invention.

This antenna system includes a cylindrical electromagnetic lens 1 and a superstrate 2*a* coupled to the cylindrical lens 1.

Figure 3A:
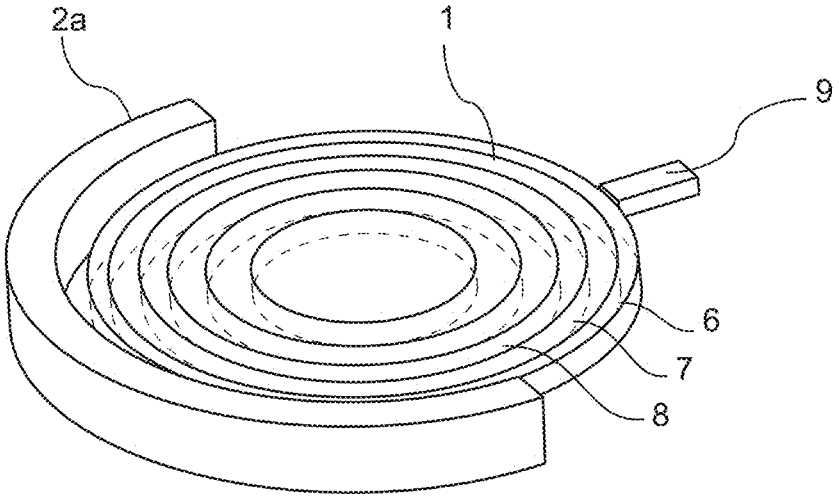
FIG. 3*a* is a view of the device of FIG. 1*a*, without the shields, thus showing the cylindrical electromagnetic lens according to embodiments of the invention.

As it will be explained in further detail below, this cylindrical lens 1 is composed of several crows 6, 7, 8, as visible in FIG. 3*a*, in order to be in conformity with the Lüneburg law. This cylindrical lens is for instance implemented in the form of the electromagnetic lens 200 presented below with reference to FIG. 5*a* in particular.

In the embodiment shown in FIG. 1*a*, the cylindrical lens 1 is sandwiched between a top shield 3 and a bottom shield 4 made of a conductive material, the top shield 3 and the bottom shield thus forming a conductive mounting receiving the cylindrical lens 1.

The superstrate 2*a* is a ring-shaped member made of a dielectric material (e.g. Teflon®, i.e. PTFE: polytetrafluoroethylene) and partially surrounding the cylindrical lens 1. In the present embodiment, the superstrate 2*a* extends over a least a half circle arc in the azimuthal plane; it is also proposed here that, in such an azimuthal plane, the centre of the cylindrical lens 1 is identical with the centre of the circle arc where the superstrate is located.

Precisely, the superstrate 2*a* has a first external surface defined by a first cylinder having a first radius and a second external surface defined by a second cylinder having a second radius smaller than the first radius. The second external surface faces the lateral (cylindrical) face of the cylindrical lens 1 over half the circumference of the cylindrical lens 1 and at a constant distance therefrom. Here, the first cylinder and the second cylinder have a common axis, which is also the axis of the cylindrical lens 1.

As just noted, in the present embodiment, the superstrate 2*a* is at a distance from the cylindrical lens 1; said differently, the second external surface of the superstrate 2*a* is not contacting the external surface of the cylindrical lens 1. In addition, the superstrate 2*a* has a height (perpendicular to the azimuthal plane, i.e. along the direction of the axes just mentioned) which is larger than the height of the cylindrical lens 1.

In this example, the cross section of the superstrate 2*a* has a rectangular shape. However, it may have other shapes.

For example, a side of the rectangular section may have a length equal to N times the wavelength of the operational frequencies. For optimal performances, the value of N may be selected between 1 and 1.5. For example, in the 60 GHz frequency band, the dimension of the side can be selected between 5 mm and 8 mm. The rectangular shape, in particular its property to internally reflect and recombine electromagnetic waves, advantageously makes it possible to have a good focusing effect in the elevation plane with small dimensions.

Other focusing techniques may be envisaged in order to obtain similar focusing effect. For instance, dielectric lenses having a cylindrical shape may be used. However, in order to provide a focusing effect similar to the one obtained with the rectangular cross-section shape, the diameter of the dielectric lens has to be about 5 to 10 times the wavelength (instead of 1 to 1.5 times the wavelength for the rectangular shape).

Figure 4:
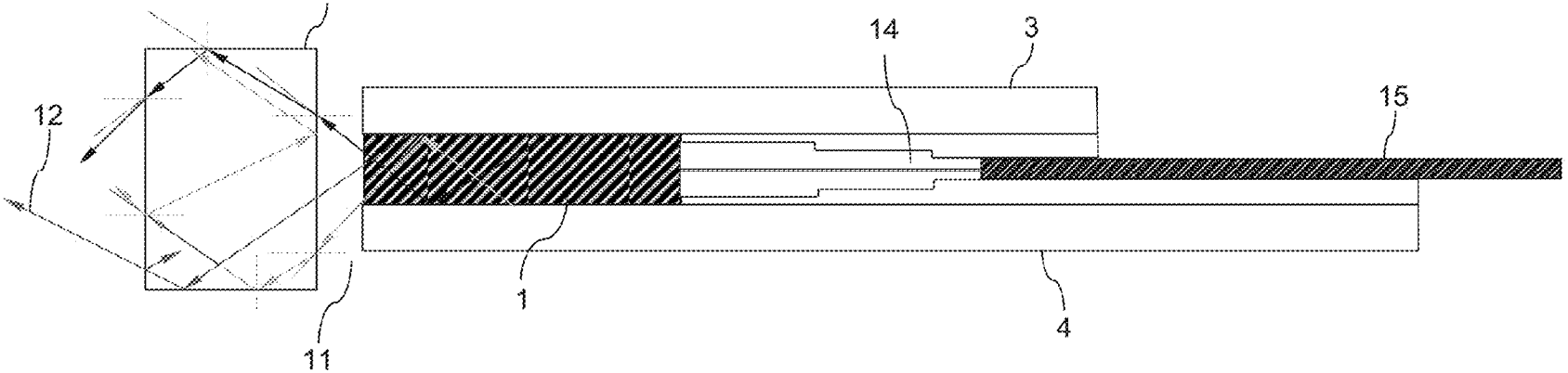
FIG. 4 shows an exemplary ray tracing showing the orientation of electromagnetic waves in the (vertical) elevation plane.

An RF source 9 (comprising e.g. a feeding circuit 15 and a waveguide 14, here formed in the conductive mounting, as visible in FIG. 4) may be located at any focal point 5 of the lens circumference, here preferably on the half part of the lens circumference situated opposite the superstrate 2*a*. Several (selectable) RF sources may be used as further explained below at distinct locations along the lens circumference in order to obtain several corresponding directions for the beam emitted by the antenna system. According to a possible variation, a single RF source may be used, that is movable along the circumference of the cylindrical lens 1.

Figure 1B:
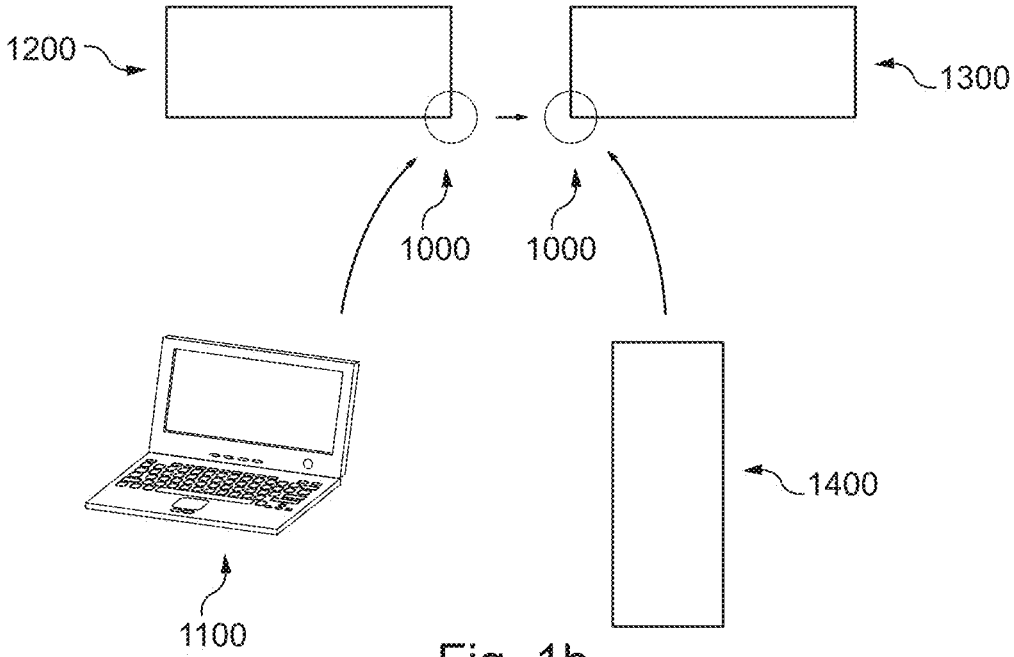
FIG. 1*b* illustrates an example of application performing short-distance communications and long-distance communications, and requiring a flexible antenna gain, in which an antenna system according to embodiments of the invention may be used.

FIG. 1*b* illustrates a context of implementation of embodiments of the invention that will be described in details with reference to FIG. 1*c* to 1*e*.

Video data is transmitted, for example over a 60 GHz link, from a source device 1100 (e.g. a personal computer) or 1400 (e.g. a tablet) to a cluster of devices, typically video projectors 1200 and 1300.

As video data to display are shared between both video projectors 1200 and 1300, the master video projector (in this example 1200) transmits to the other video projector (in this example 1300) the video data by a 60 GHz radio link. The video projectors may be separated by a short distance (e.g. nearly 2.5 meters).

The source devices 1100 and 1300 may be separated from the video projector 1200 by a long distance, for example 5 meters.

The video projectors 1200 and 1300 are equipped with antenna systems 1000 with a high gain for long distance communications (with the source device) and with a low gain and a wide beam for the short distance communications (between the video projectors).

As will be described below, an antenna system according to embodiments of the invention allows a good flexibility of the positioning of the video projectors, since variable output widths may be obtained with the same antenna system.

Figure 1C:
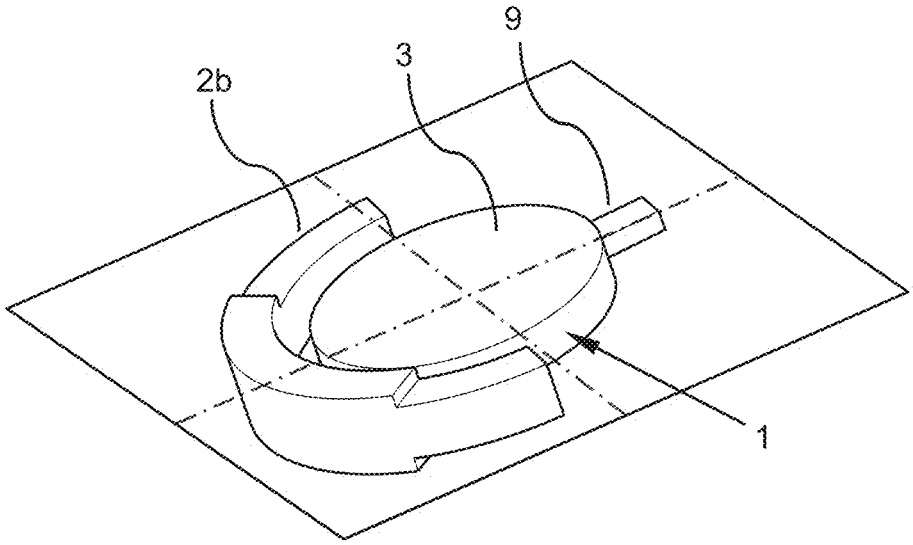
FIG. 1*c* shows an antenna system according to a possible embodiment of the invention, which can be used in the example of FIG. 1 *b;*

FIG. 1*c* shows an antenna system, designed according to embodiments of the invention. Hereafter, the antenna is used as a radiating device. However, it may be used as a receiving device.

In particular, the embodiments described hereafter with reference to FIGS. 1*c* to 1*e* relates to variants of the embodiments of FIG. 1*a*, wherein the superstrate has a shape particularly well adapted to address the flexibility requirements described with reference to FIG. 1*b*.

As explained hereinabove, the rectangular shape of the cross-section of the superstrate 2*b* makes it possible to obtain a good focusing effect while keeping the dimensions of the superstrate rather small.

Consequently, the elements referenced 1, 3, 9 are the same as on FIG. 1*a*, and only the superstrate 2*b* differs from the superstrate 2*a* of FIG. 1*a*.

Figure 3B:
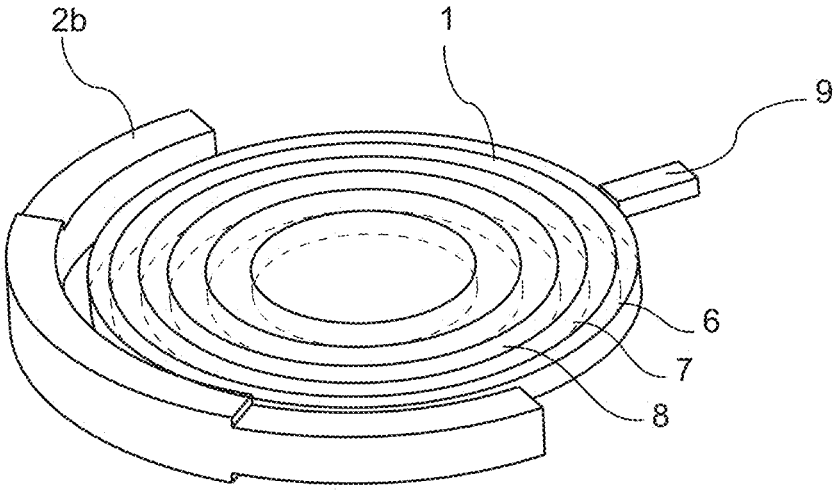
FIG. 3*b* is a view of the device of FIG. 1*c*, without the shields, thus showing the cylindrical electromagnetic lens according to other embodiments of the invention.

The cylindrical lens 1 is composed of several crows 6, 7, 8, as visible in FIG. 3*b*, in order to be in conformity with the Lüneburg law. This cylindrical lens is for instance implemented in the form of the electromagnetic lens 200 presented below with reference to FIG. 5*a* in particular.

In the embodiment shown in FIG. 1*a*, the cylindrical lens 1 is sandwiched between a top shield 3 and a bottom shield 4 made of a conductive material, the top shield 3 and the bottom shield thus forming a conductive mounting receiving the cylindrical lens 1.

In this example, the superstrate 2*b* is a ring-shaped member with a variable height. On the example of FIG. 1*c*, as can be seen in detail in FIG. 1*d*, the superstrate 2*b* comprises three portions: the two portions at the edge have a height $h_1$ and the central portion of the superstrate 2*b* has a height $h_2$ with here $h_1<h_2$. The more a superstrate portion is high, the more the output beam is wide.

This variation in height within the superstrate 2*b* is useful to obtain different results as regards beam forming. In particular, as can be seen in FIGS. 12*a* and 12*b*, the variation of the height of the superstrate 2*b* makes no change in the azimuthal plane where the antenna aperture stays at about 5°.

Figure 12A:
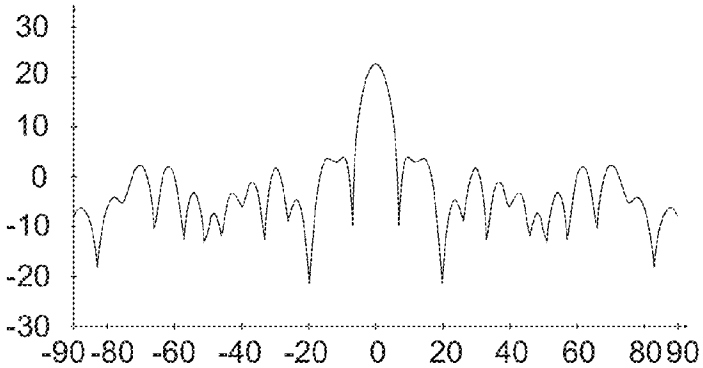
FIGS. 12*a*-12*d* present simulation results obtained using the antenna system with the superstrate of variable height, in azimuth and in elevation.
Figure 12B:
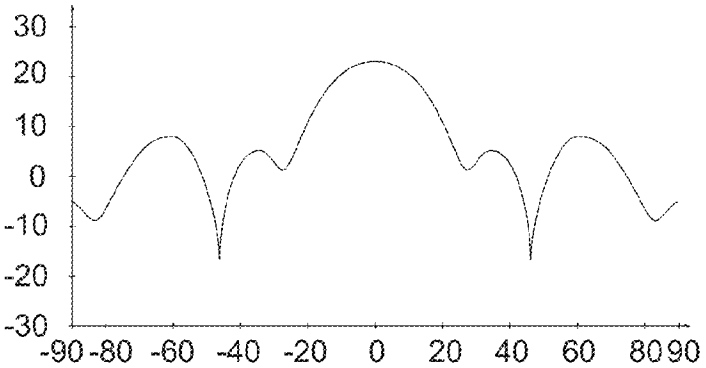

One may note that the superstrate aims at modifying the width of beam output in elevation but not in azimuth, thus the width in azimuth of the beam output from the cylindrical lens (before the superstrate 2*b*) is essentially the same as the beam output from the superstrate (see FIG. 12*a* and FIG. 12*b*).

As explained above, the addition of the superstrate provides an increase of the directivity in the elevation plane, where the aperture of the single antenna is reduced. The superstrate thus makes it possible to focus the beam from a beam having (in elevation) a first (angular) width output from the cylindrical lens to a beam having a second (angular) width (in elevation), smaller than the first width, output from the superstrate.

Figure 1D:
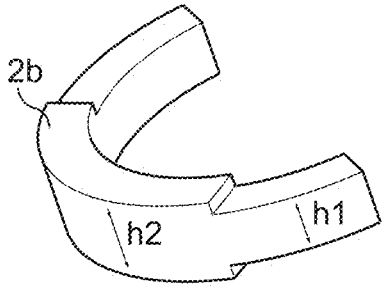
FIG. 1*d* shows a dielectric member (or superstrate) used in the antenna system of FIG. 1*c;*
Figure 12C:
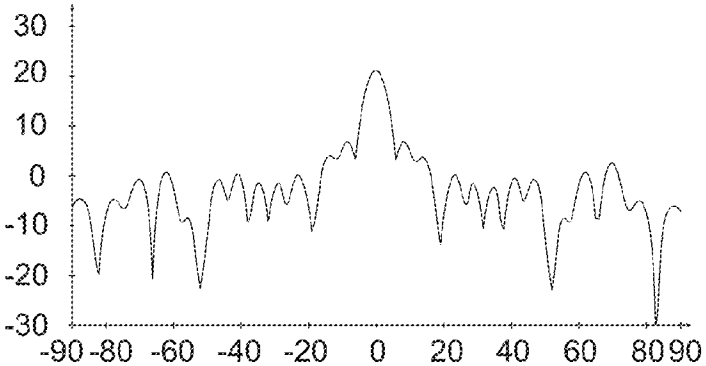
Figure 12D:
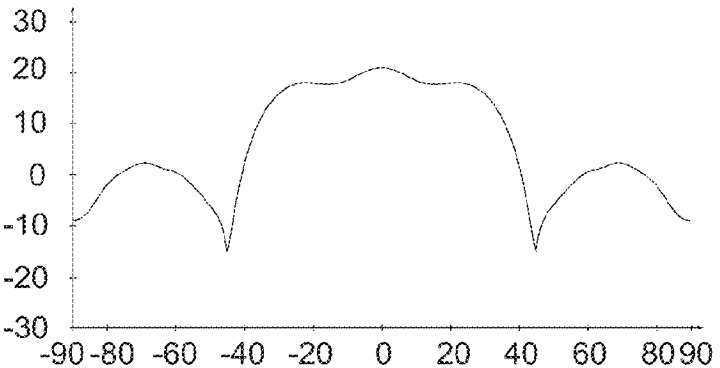

In addition, considering the superstrate 2*b* in the embodiment of FIGS. 1*c* and 1*d*, the variation of height between the edge portions of height $h_1$ and the central portion of height $h_2$ makes the elevation width increase from 21.4° (edge portions—see FIGS. 12*c*) to 60° (central portion—see FIG. 12*d*).

In a corresponding manner, the total antenna gain grows from 23 dB when the beam enters an edge portion of the superstrate to 20 dB when the beam is directed towards the central portion of higher height.

Consequently, such a superstrate with a variable height makes it possible to increase the global antenna gain or reduce it depending on the targeted application, and correspondingly to reduce or increase the beam width in the elevation plane without modifying the beam width in the azimuthal plane.

Thanks to the variable height of the superstrate 2*b*, the antenna system according to the invention can reach devices located both in a mid-range (up to 10 meters from the antenna system) and in a long-range (up to 30 meters), depending on the height of the portion of the superstrate 2*b* through which the incoming beam passes.

The results in terms of beam forming may also differs depending on the thickness of the superstrate 2*b* (which is constant in the example of FIG. 1*d*) and the distance from the lens output (i.e. the distance between the second external surface of the superstrate and the lateral face of the cylindrical lens). Thus, the results shown in FIGS. 12*a*-12*d* are obtained for specific conditions and are only given as non-limitative examples.

Obviously, the superstrate 2*b* may have a different shape than the one of FIGS. 1*c* and 1*d*, due to a different kind of variation in height.

Figure 1E:
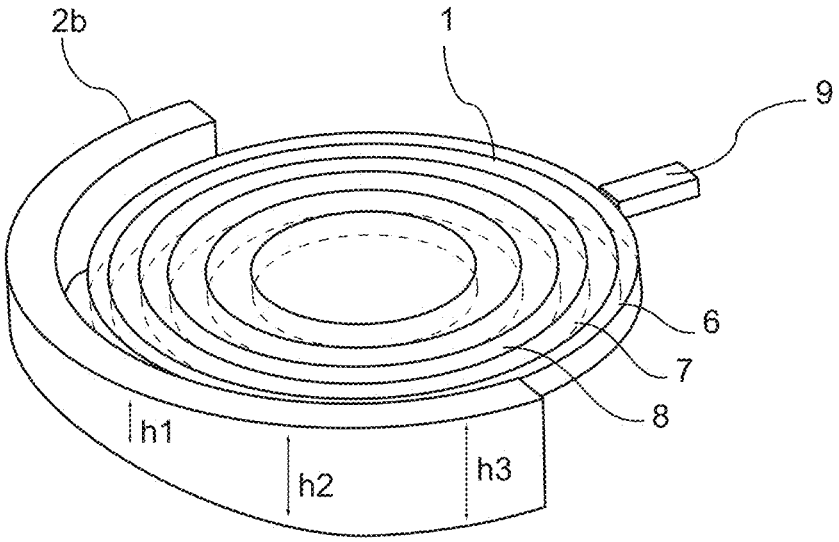
FIG. 1*e* shows another shape of dielectric member (or superstrate) that could be used in an antenna system according to another possible embodiment of the invention.

For instance, in a variant shown in FIG. 1*e*, the variation in height of the superstrate 2*b* is more complex. Indeed, different portions of the superstrate 2*b* have three different heights $h_1$, $h_2$ and $h_3$.

Other kinds of variation in height, more or less smooth, may be used. For instance, constant increasing from the center of the superstrate 2*b*, or the inverse situation of FIG. 1*c* with $h_1 > h_2$ i.e. edge portions higher than the central portion of the superstrate 2*b*.

In practice, the superstrate 2*b* may also be made of a dielectric material (e.g. Teflon®, i.e. PTFE: polytetrafluoroethylene) and partially surrounding the cylindrical lens 1.

In the present embodiment, the superstrate 2*b* also extends over a least a half circle arc in the azimuthal plane; it is also proposed here that, in such an azimuthal plane, the centre of the cylindrical lens 1 is identical with the centre of the circle arc where the superstrate is located.

Precisely, the superstrate 2*b* has a first external surface and a second external surface closer to the cylindrical lens 1. The second external surface faces the lateral (cylindrical) face of the cylindrical lens 1 over half the circumference of the cylindrical lens 1 and at a constant distance therefrom.

As just noted, in the present embodiment, the superstrate 2*b* is at a distance from the cylindrical lens 1; said differently, the second external surface of the superstrate 2*b* is not contacting the external surface of the cylindrical lens 1.

An RF source 9 (comprising e.g. a feeding circuit 15 and a waveguide 14, here formed in the conductive mounting, as visible in FIG. 4) may be located at any focal point 5 of the lens circumference, here preferably on the half part of the lens circumference situated opposite the superstrate 2*b*. Several (selectable) RF sources may be used as further explained below at distinct locations along the lens circumference in order to obtain several corresponding directions for the beam emitted by the antenna system. According to a possible variation, a single RF source may be used, that is movable along the circumference of the cylindrical lens 1.

According to the invention, depending on the position of the RF source at the circumference the lens, the width of the output beam from the antenna system may be different, since the superstrate may have different heights for different positions of the source.

Figure 2:
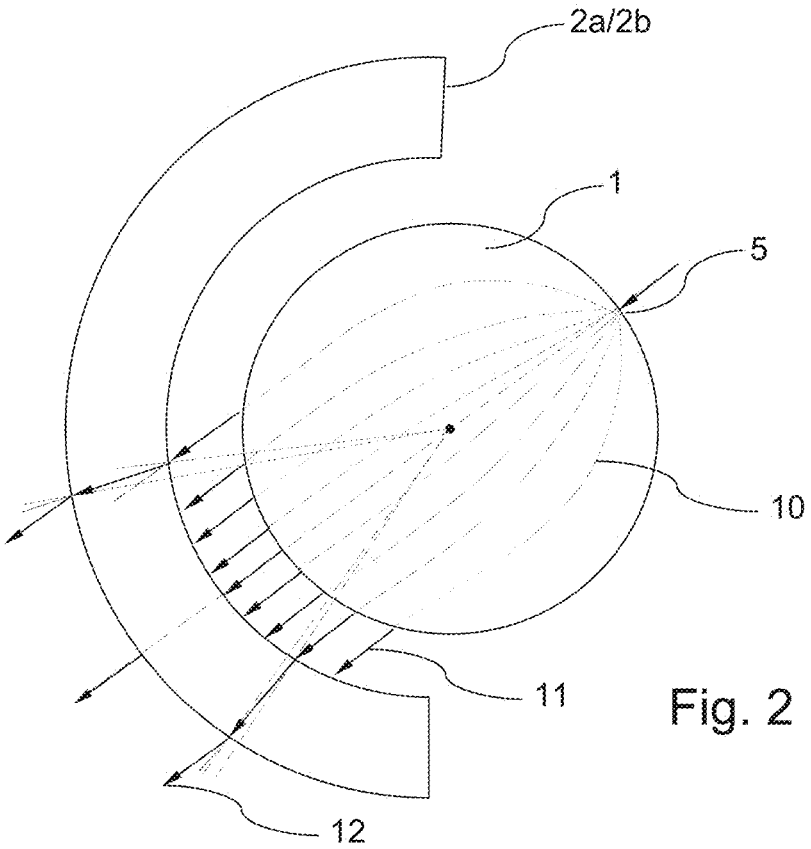
FIG. 2 shows an exemplary ray tracing showing the orientation of electromagnetic waves in the azimuthal plane.

FIG. 2 is an exemplary ray tracing showing the orientation of electromagnetic waves in the azimuthal plane for the device embodiments of which have just been described.

An electromagnetic spherical wave is generated at a source point 5 situated on the lens circumference (in the half part of the circumference opposite the superstrate 2*a* or 2*b*). The permittivity variation following the Lüneburg law transforms the spherical wave in an almost plane wave 11 at the lens output: a beam having a small angular width is emitted from an emerging area in the external surface of the cylindrical lens 1.

Precisely, the spherical wave emitted from the feed wave guide (see descriptions of FIGS. 9*a*-9*b* and 10*a*-10*d* for further description in this respect) at the focal position 5 passes through dielectric materials within the lens antenna with a speed slower than the speed of light in vacuum. The wavelength is therefore shortened for constant frequencies and dependent on the relative dielectric constant of each successive material. The wave path length to the aperture is not constant but the phase and amplitude at the aperture do remain so. A plane wave 11 is therefore theoretically generated.

In other words, the electromagnetic energy is concentrated in a narrow beam in the azimuthal plane thanks to the cylindrical lens 2. In practice, the width of this beam depends of the lens diameter, i.e. the lens capacity to concentrate the electromagnetic wave, and the height (or thickness) of the cylindrical lens.

In the elevation plane however, the electromagnetic wave are less concentrated and the beam is wider. The use of the superstrate makes it possible to improve the energy concentration in the elevation (or vertical) plane as explained below.

Rays 11 output from the cylindrical lens and incident on the superstrate 2 pass through dielectric materials within the superstrate arc 2 at a speed slower than the speed of light in vacuum. The wavelength is therefore shortened for constant frequencies. Thanks to the ring shape of the superstrate 2, the wave path length to the exit face (first external face) is constant, as the phase and the amplitude. As the properties of the electromagnetic signal are not changed by the superstrate 2, a corresponding plane wave 12 is thus generated.

In other words, the directivity is kept across the superstrate in the azimuthal plane.

FIG. 4 is a vertical cross section of the antenna system with a superstrate arc 2 corresponding for instance to superstrate 2*a* of FIG. 1*a* or to superstrate 2*b* of FIGS. 1*c*-1*e*. A tentative ray tracing is shown in this cross section.

Even if the height of the superstrate is variable (superstrate 2*b* of FIGS. 1*c*-1*e*) along the circumference, a vertical cross section of it always leads to a rectangular shape. The man skilled in the art can thus easily deduce from the description below the path of any ray in another vertical cross section of the antenna system.

At the output of the lens 1, the electromagnetic wave rays 11 in free air have approximately the speed of light in vacuum. Then at the superstrate surface, in conformity with refraction laws (at the air-superstrate interface), the incident ray angles are different for each ray, equally for the path length inside the dielectric material of the superstrate.

Depending on the dimensions of the superstrate section and the distance from the lens output (distance between the second external surface of the superstrate and the lateral face of the cylindrical lens), different results may be obtained as regards beam forming. To concentrate the energy and increase the antenna directivity in elevation and the antenna gain, particular dimensions are selected and give the results described below in view of FIGS. 11*a*-11*d*, and 12*a*-12*d*.

This phenomenon may be explained by the increase of the radiated surface, i.e. of the aperture of the antenna system (when considering the superstrate 2 compared to the cylindrical lens 1). By an appropriate choice of the (superstrate) arc dimensions and of the superstrate material (here PTFE), and thanks internal reflections, the electromagnetic rays are recombined on a bigger surface at the output of the superstrate arc (than at the output of the cylindrical lens). As a result, the directivity of the antenna in the elevation plane is increased.

A preferred embodiment of a multi-beam antenna according to the invention is represented in FIG. 5*a* and comprises an electromagnetic lens 200 having a substantially cylindrical shape. By way of example, the relative dimensions (form factor) of the electromagnetic lens are as follows:

diameter/height=9.33.

The diameter of the electromagnetic lens 200 is for example of 28 mm and this value is chosen so as to obtain a beam having an azimuth pattern (3 dB) of less than 15 degrees, and approximately 10 degrees. This value is obtained from the two following equations:

$$G = \frac{32000}{\theta_E \theta_A}$$

$$G = 10\log\left(\frac{\prod \cdot D}{\lambda}\right)^2$$

where G, $\theta_E$, $\theta_A$, D, $\lambda$ stand for quantities expressed in units as indicated herebelow:

G, dimensionless antenna gain;

$\theta_E$, elevation angle in degrees (which may vary, given the variable height of the superstrate);

$\theta_A$, azimuthal angle in degrees;

D, diameter of the electromagnetic lens in meter;

$\lambda$, wavelength in meter.

In the embodiment considered here, the following values are taken, from which results the diameter D proposed above:

$\theta_E$=70 degrees or 50 degrees (when using for example the superstrate shape of FIG. 1*d*);

$\theta_A$,=10 degrees;

$\lambda$=4.49 $10^{-3}$ m.

As schematically represented in FIG. 5*a*, the electromagnetic lens 200 is encapsulated partially by an electromagnetically shielding member contained here in a two-part enclosure. Alternatively, the electromagnetic lens may be enclosed within:

a one-part enclosure or casing; or in an enclosure or casing having more than two parts.

The two-part enclosure represented in FIG. 5*a* comprises an upper part 120 and a lower part 130 each partially surrounding or bounding the electromagnetic lens. In this embodiment the upper and lower parts are maintained together by means of screws 110, 115 and those to be inserted in the hole 145 and following holes.

This enclosure comprises metallic material.

The multi-beam antenna comprises e.g. sixteen (16) antenna transmission means. Each antenna transmission means comprises ridged wave guides 125 that are formed in the metallic enclosure encapsulating the electromagnetic lens. The metallic enclosure directs the electromagnetic signal and guarantees that a beam has a controlled opening in elevation. This opening depends solely on the cylinder height. The azimuth pattern of the beam is, in turn, determined by the parameters selected for the determination of the diameter of the cylinder according to the preceding equations.

The antenna transmission means are arranged around the circumference of the cylindrically-shaped electromagnetic lens. As the revolution form creates space, the waveguides are part of the antenna transmission means and are not generating mutual inductance. There is no planar symmetry in the preferred embodiment, thereby avoiding waste of energy. The power consumption of the antenna system is thus reduced.

The upper part 120 and lower part 130 of the electromagnetically shielding member maintain therebetween a Printed Circuit Board 150 (referred to as PCB 150), carrying the conveying means which are adapted to convey the electrical signal between respective circuits of PCB 150 and the antenna transmission means. For the sake of clarity the conveying means are not represented here in FIG. 5*a*.

Antenna transmission means can possibly be made by using well known techniques such as Microstrip or Co Planar Waveguide (CPW) lines.

As represented in FIG. 5*a*, two (2) screws 110 enable fastening of PCB 150 to the lower part 130 of the enclosure. As to the upper part 120, seventeen (17) screws (one being represented with reference 115 and the remaining are to be inserted in the hole 145 and the following ones) attach the upper 120 and lower part 130 of the enclosure together. The holes 145 and following ones are drilled in between the plurality of cavities formed by parts 120 and 130. In the embodiment considered here, the seventeen (17) holes are interleaved by the sixteen (16) cavities. The number of waveguides 125, as well as the number of assembling/mounting screws 115 (and those to be inserted in the holes 145 and following), are given here as non-limitative examples. These numbers are the result of the specification for a beam covering a width of 140 degrees, and may thus vary according to the needs. They are given only by way of example and should not be considered as limitative. The aim is to obtain a perfect contact between the two parts of the enclosure without any air gap in between these parts of the enclosure.

FIG. 5*b* is a cross-section view of the corresponding antenna as represented in FIG. 5*a*. The cross section is taken along the ridge of one of the waveguides 125. In FIG. 5*b*, PCB 150 is represented as being clamped between the two parts 120 and 130 of the metallic enclosure. An internal cavity 160 is formed thanks to the stepped recesses provided in the internal faces of the two parts 120 and 130 of the metallic enclosure. Cavity 160 constitutes a ridged waveguide. The cylindrical shaped electromagnetic lens is partially encapsulated by an upper part 120 and a lower part 130 of the enclosure, thereby leaving free a side or peripheral wall of the lens. For the sake of clarity, holes 145 (represented in FIG. 5*a*) are not shown in the cross-section (FIG. 5*b*).

The electromagnetic lens 200 comprises media having a varying permittivity and is adapted to guide electromagnetic signals by means of said variation in permittivity. The term "guide" means that the electromagnetic signal propagation through the lens is directed thanks to the variation in permittivity. It is to be noted that the signal is guided in a direction that is substantially parallel to the variation in permittivity of the lens thanks to the shielding member (enclosure). This guidance contributes to making the multi-beam antenna capable of controlling a large elevation pattern of the main beam while ensuring a narrow beam in azimuth and also capable of orienting said narrow beam within a very large sector in azimuth. Antennas according to the invention can thus be widely steered in the above range.

In a particular implementation, the electromagnetic lens comprises an inner part and an outer part, said inner part contains a plurality of holes and said outer part is formed in the present example as the superposition of several homogeneous layers, each having a different permittivity. The homogeneous layers of the outer part of the electromagnetic lens are here made of different foam materials, each foam material has a specific permittivity.

In the embodiment described here, the electromagnetic lens is cylindrical in shape and the homogeneous layers are concentric around the symmetry axis of said electromagnetic lens.

FIG. 6 shows a cross-section of an implementation of the cylindrically-shaped electromagnetic lens 200 as used in the preferred embodiment. The height H of the electromagnetic lens 200 cylinder is for example of three millimetre (3 mm).

The inner part of electromagnetic lens 200 is a core cylinder 210, made of Teflon®; holes are drilled through core cylinder 210 according to the rules outlined hereafter. The relative permittivity of Teflon® material is for example as follows:

$\in_r$=2.04.

The outer part of the electromagnetic lens comprises two concentric layers. The first (central) layer 220 is made of a crown made of foam material having a relative permittivity for example as follows:

$\in_r$=1.45.

The second (peripheral) layer 230 is made of a crown made of a foam material having a relative permittivity for example as follows:

$\in_r$=1.25.

The foam material can possibly be Emerson and Cuming Eccostock® or DIAB Divinycell®.

Holes are drilled in the inner part (core cylinder 210) of the electromagnetic lens, with a diameter of 0.4 mm. The drilling rules are given first by dividing the surface of the lens into several sub-sections, then holes are positioned so that the ratio of the volume of the air over the total volume that is under the sub-section surface and the ratio of material volumes over the total volume under the sub-section multiplied by their respective permittivity leads to an average permittivity which is defined by the Lüneburg law outlined in "*A Sliced Spherical Lüneburg Lens*", S. Rondineau, M. Himdi, J. Sorieux, in IEEE Antennas Wireless Propagat. Lett., 2 (2003), 163-166.

It is recommended not to drill following a line or a radius if a given mechanical strength is to be obtained.

It is important to emphasize that, according to the prior art, an implementation of an electromagnetic lens having drilling holes may result in a fragile lens as many holes are necessary near the boundary of the electromagnetic lens. Consequently, such lenses are fragile and their construction may even not be feasible. The implementation of the electromagnetic lens in a two-part construction (inner part with holes and outer part comprising at least a homogeneous layer) provides an improvement in this respect in particular. Moreover, in the embodiment described, the assembling of the electromagnetic lens does not require any glue material as the cylindrical lens is locked in the enclosure (crown). Besides costs aspects, if glue is used to assemble the foam layers together, this may modify the permittivity of the foam. Moreover, as the inner part of the cylinder is in plain material according to the invention, it can mechanically and reliably support locking means for fixing the electromagnetic lens to the enclosure.

The variation in permittivity is implemented through the presence of air in the drilled holes or in the foam. Thermal dissipation is thus facilitated, resulting in an efficient transmission of power. In addition, the electromagnetic lens is easy to be assembled and can be carried out in various low cost technologies as outlined hereafter and at various frequencies according to the preceding formulas expressing the relations between antenna gain, the elevation and azimuth angles, the diameter of the electromagnetic lens and the wavelength.

In the first preferred embodiment, the enclosure (shielding member) is made of metallic material that is micro-machined so as to form the ridged waveguides.

Alternatively, the enclosure body is made of moulded plastic and the electromagnetically shielding member is a metallized part of the enclosure boundary portion. Although metallized plastic waveguides are seldom used, experiments show that these techniques can successfully be applied. The plastic material can be loaded with metallic particles. In such implementations, the enclosure boundary portion has to be appropriately metallized. This can advantageously be obtained by using electroplating techniques.

In particular, when contemplating mass production, easy mounting and positioning of the constituting parts of the antenna is of interest.

In this respect, the antenna may comprise locking means for locking said electromagnetic lens in the enclosure. Said locking means may advantageously comprise either at least one wiring means surrounding partially the electromagnetic lens and locking it in the enclosure, or at least one pin and a corresponding recess for accommodating each pin and that are both adapted to lock the electromagnetic lens in the enclosure, said at least one pin and recess being respectively part of the electromagnetic lens and the enclosure or vice versa.

Mounting means are represented by way of example in FIGS. 7*a* and 7*b* where the electromagnetic lens 300 comprises two centering pins, one on the upper part (upper face) and one on the lower part (opposed lower face) of the electromagnetic lens while the enclosure encapsulating partially the electromagnetic lens comprises corresponding recesses in the upper part 320 (lower face) and lower part 330 (upper face) thereof. The dimensions of each pin and corresponding recess are complementary to each other. In a preferred example, the height of the penetrating pin in the recess is less than a tenth of the wavelength in order not to alter the electromagnetic characteristics FIGS. 8*a* and 8*b* illustrate two views of an alternative arrangement for the locking means of FIG. 7*a* that can be used in an antenna system according to embodiments. Here, the locking means comprise wiring means. More particularly, wire 410 is made of a dielectric material having a permittivity close to one (1) or alternatively is made of a material, similar to those constituting the peripheral crown, thus avoiding a significant variation in permittivity. The wire 410 is partially encircling the cylindrically-shaped electromagnetic lens 200 and is attached to the enclosure body encapsulating partially said electromagnetic lens 200 (see top view in FIG. 8*b*). The attachment can be achieved through the use of pins 420 clamping the wire 410 to said enclosure body.

In another variant, the enclosure comprises an enclosure body and an enclosure boundary portion body comprises ceramic substrate and the at least one electromagnetically shielding member is a metallized member of the enclosure boundary portion. In this implementation, the plurality of antenna transmission means may advantageously comprise one or several wave guides integrated into the substrate by using for example Substrate Integrated Waveguide (SIW) techniques.

Figure 9A:
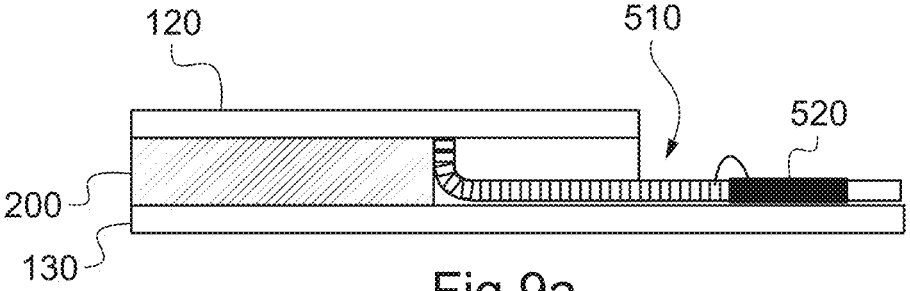
FIGS. 9*a* and 9*b* represent an alternative implementation the electromagnetic lens assembly.
Figure 9B:
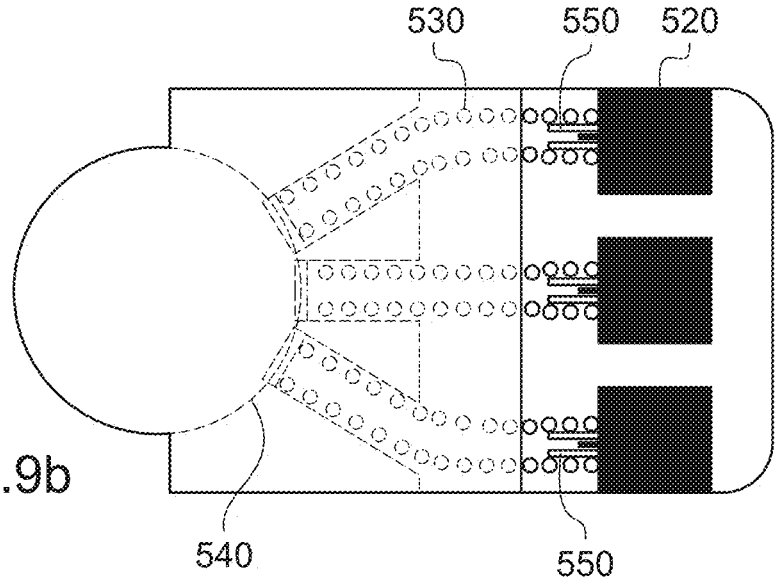

FIGS. 9*a* and 9*b* represent a cross-section and a top view of an arrangement, where the enclosure is made of multi-layer ceramic and the conveying means are made through the use of said Substrate Integrated Waveguide technique. Advantageously, this technique provides a better integration as well as an increased efficiency. Instead of using metallic parts, the enclosure body 120 and 130 can here possibly be made either of glass, or of Low Temperature Co fired Ceramic, or High Temperature Co Fired ceramic. A metallic layer forms the electromagnetic shielding member and is part of the enclosure boundary portion. Said metallic layer is on the inner faces of the enclosure (lower and upper faces) that are in contact with the electromagnetic lens 200.

The Substrate Integrated Waveguide implemented in this variant may be made of a thin substrate made of Dupont Kapton® or Rogers® materials laminated and tied together with two layers of metal. This implementation offers flexibility and excellent physical characteristics at high frequencies.

The circuits 520 that generate the electrical signal are active devices that have to be glued onto the lower metallized layer of the Substrate Integrated Waveguide 510. On the upper metallic layer of the Substrate Integrated Waveguide 510, certain trenches 550 (hole having a rectangular form, obtained by etching) can be provided in order to obtain a CPW form. Alternatively, micro-strips can advantageously be used to connect to active circuits. A CPW form is considered as a strip of copper on a surface of insulating material. This strip is surrounded by a limited absence of copper (the trench). The copper following the trench is tied to ground. A microstrip has an unlimited absence of copper surrounding it. The ground layer is on the other side of the insulating material. The electrical field stays above the substrate in CPW, while it goes through in microstrip.

Each integrated Waveguide 510 is bounded by metallized holes 530 (also referred to as posts or vias). The metallized holes 530 penetrate the whole substrate, thus forming an electromagnetic barrier. The waveguides constructed in this way represent the conveying means of the antenna transmission means and convey an electrical signal output by circuit(s) 520 to the lens. The lens may be provided with trenches 540 that mechanically retain each a corresponding Substrate Integrated Waveguide. It is to be stressed here that SIW technologies together with the construction of waveguides by using metallized holes, considerably reduce the costs and moreover enable miniaturization of the antenna.

FIGS. 10*a*-10*d* show additional details to the Substrate Integrated Waveguide technique that may be applied, in addition either to a multilayer ceramic technique or to a metallic mounting technique.

Figure 10A:
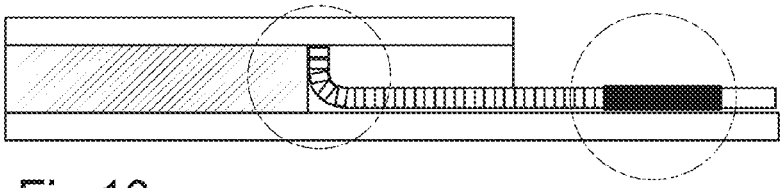
FIGS. 10*a*-10*d* show different views of the assembly of FIGS. 9*a* and 9*b;*
Figure 10B:
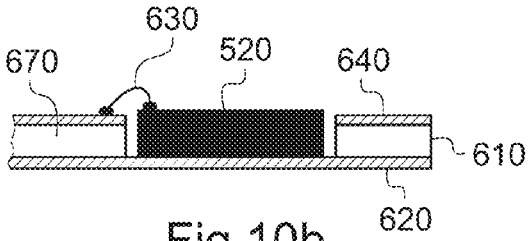
Figure 10C:
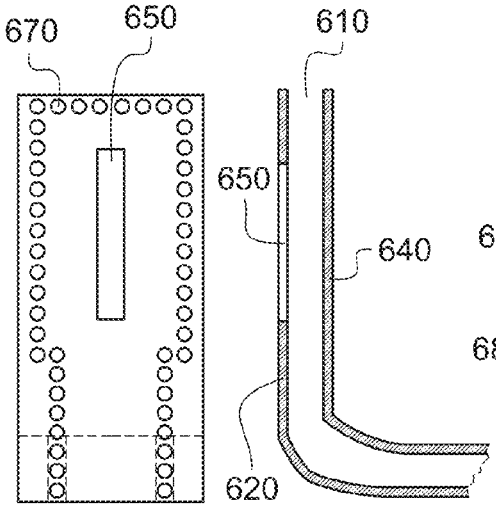

In FIG. 10*b*, the metallized through holes 670 form a barrier confining the electromagnetic wave with the help of the two metallic horizontal layers. The latter are connected to active devices 520 via a bond wire 630 that is soldered. In order to achieve the transition, copper is removed to obtain a Co Planar Waveguide form. A transition occurs whenever the device carrying the waveform is replaced by another one, e.g. a waveguide to CPW or CPW to microstrip form a transition. The bond wire is tied to the beginning of the CPW line and the Substrate Integrated Waveguide is powered by the other end of the CPW line. The bond goes to the upper layer 640. The substrate 610 is, by way of example, made of Dupont Kapton® or Rogers® laminated material. FIG. 10*c* shows the other part of the antenna transmission means which are in contact with the electromagnetic lens. This part comprises a trench made in the electromagnetic lens 200, while the Substrate Integrated Waveguide forms a slot antenna. The slot 650 is obtained by removing copper from the lower layer 620. This can be achieved thanks to the properties of the waveguide. Indeed, active layers can be inverted between the input of the waveguide and its output. It is important to highlight here that the Substrate Integrated waveguide is thus directly in contact with the electromagnetic lens through the slot 650.

Figure 10D:
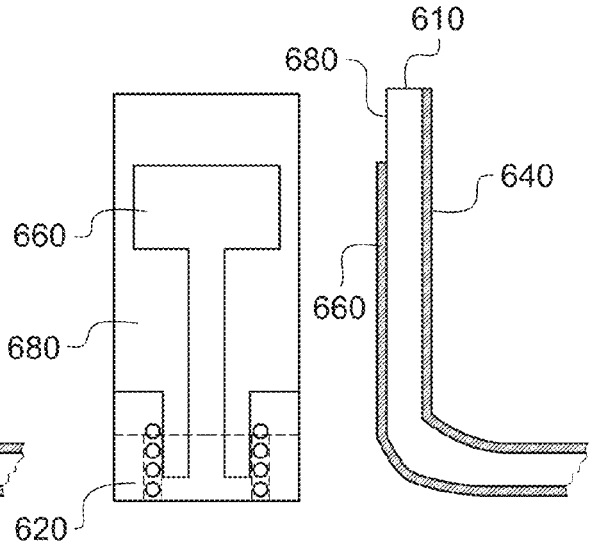

FIG. 10*d* represents an alternative implementation of the slot antenna, where the Substrate Integrated Waveguide excites a patch antenna. The patch 660 is obtained by removing the copper from the lower layer 620 of the surface as shown by the reference 680. The patch 660 (square form) radiates. The feeding microstrip modifies this radiation.

The dimensions of the above implementations may vary and basically depend on the frequencies of the application and the dielectric permittivity that is used. The dimensions of the slot and the patch described above are basically sized so as to be of half a wavelength in the dielectric material. It is to be noted that these basic dimensions are slightly modified to take into account the effects of edges.

The length of the slot may advantageously be a fifth of the wavelength, if half the wavelength is considered as too great. The other dimension of the path or the slot defines the impedance of the antenna. Further design and sizing criteria can be found in the book entitled: *Advanced Millimeter Wave Technologies: antennas, packaging and circuits*, Ed: D. Liu, B. Gaucher, U. Pfeiffer and J. Grzyb, Wiley 2009.

For the SIW, the distance between the metallized holes is lower than a quarter of the wavelength in the dielectric material. A plurality of via lines can be used to reduce the inter-post dimension FIGS. 11*a*-11*d* shows simulation results for the cylindrical lens 1 without superstrate (FIG. 11*a* in azimuth and FIG. 11*c* in elevation) and with the superstrate 2*a* of FIG. 1*a* (FIG. 11*b* in azimuth and FIG. 11*d* in elevation).

Figure 11A:
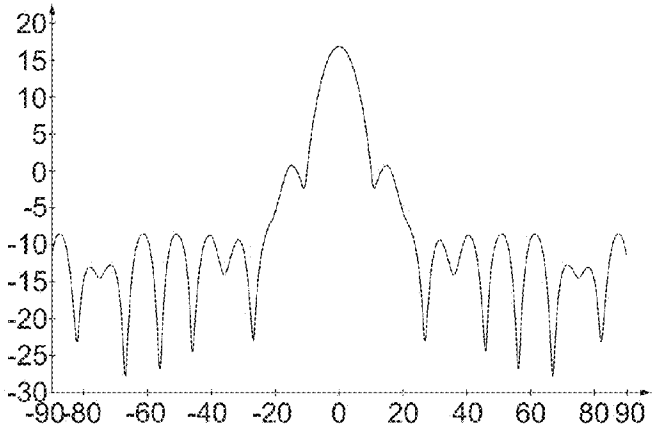
FIGS. 11*a*-11*d* present simulation results obtained using the antenna system with and without the superstrate, in azimuth and in elevation.
Figure 11C:
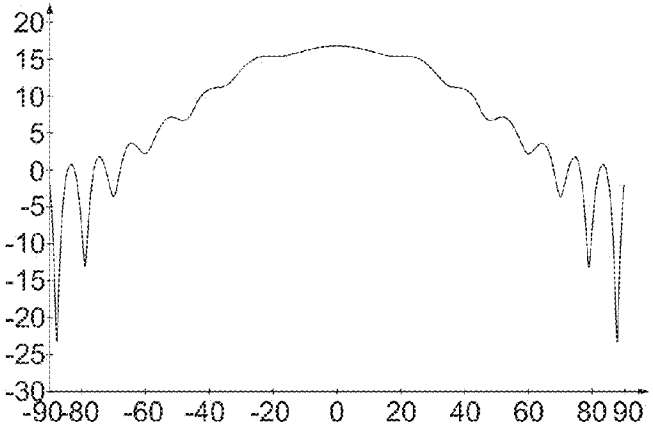
Figure 11B:
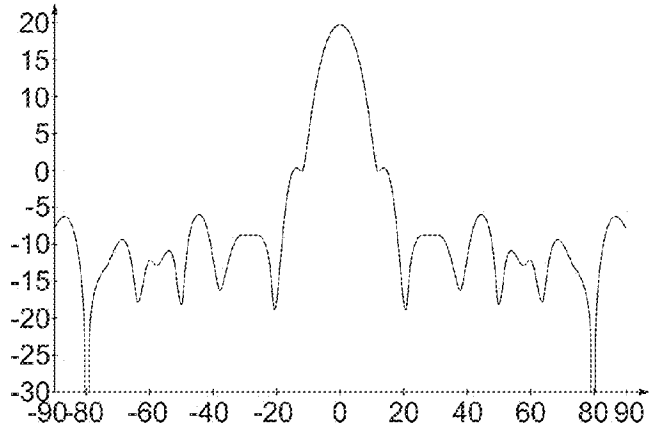

As explained above, the addition of the superstrate 2*a* makes no change in the azimuthal plane where the antenna aperture stays at 5 °: the width in azimuth of the beam output from the cylindrical lens (see FIG. 11*a*) is essential the same as the beam output from the superstrate (see FIG. 11*b*).

As mentioned above, the angular width is defined as the difference between angles for which the power is 3 dB below the peak power.

Figure 11D:
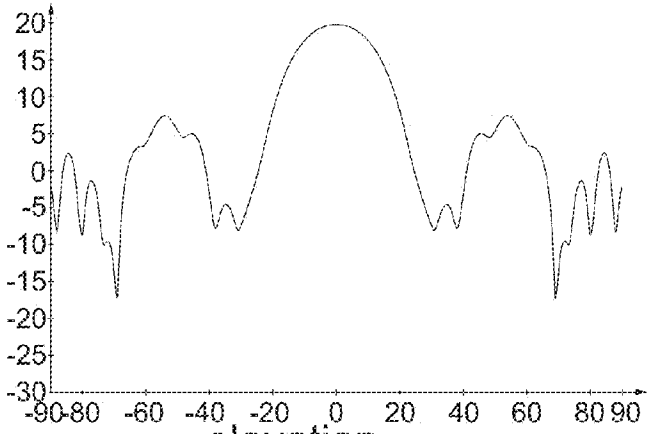

To the contrary, the addition of the superstrate provides an increase of the directivity in the elevation plane, where the aperture of the antenna is reduced from 60° (see FIG. 11*c*) to 20° (see FIG. 11*d*). The superstrate thus makes it possible to focus the beam from a beam having (in elevation) a first (angular) width output from the cylindrical lens to a beam having a second (angular) width (in elevation), smaller than the first width, output from the superstrate.

In a corresponding manner, the total antenna gain grows from 16 dB to 20 dB.

It may also be noted that the addition of the superstrate makes it possible to increase the antenna gain without increasing the gain of the side lobes (side lobes are generally not desirable). As visible from the Figures, the gain difference between the main lobe and the first side lobe is about 15 dB without the proposed superstrate (FIG. 11*a*) whereas it is about 20 dB with the superstrate (FIG. 11*b*).

In summary, the proposed antenna system includes a cylindrical lens to focus the beam in the horizontal plane (azimuthal angle) and a superstrate to focus the beam in the vertical plane (elevation angle).

The use of the superstrate thus makes it possible to increase the global antenna gain and to reduce the beam width in the elevation plane without modifying the beam width in the azimuthal plane. The superstrate is in addition easy to manufacture by known manufacturing processes, inexpensive (low cost material) and easy to implement.

The superstrate (dielectric member) may be detachably mounted in the antenna system in order to add or remove the superstrate depending on whether or not the antenna gain should be increased.

FIGS. 12*a*-12*d* shows simulation results for the cylindrical lens 1 with the superstrate 2*b* of FIG. 1*d*, when an incoming beam goes through a portion of height $h_1$ (FIG. 12*a* in azimuth and FIG. 12*b* in elevation) and through a portion of higher height $h_2 > h_1$ (FIG. 12*c* in azimuth and FIG. 12*d* in elevation).

As explained above, the addition of the superstrate 2*b*, even if it has a variable height, makes no change in the azimuthal plane in term of beam width.

As mentioned above, the angular width is defined as the difference between angles for which the power is 3 dB below the peak power.

To the contrary, the superstrate provides an increase of the directivity in the elevation plane which is flexible due to its variable height.

In particular, the more the height of the traversed portion of superstrate is high, the more the angular width in the elevation plane is big.

In a corresponding manner, the total antenna gain decreases with the height of the traversed portion.

It may also be noted that the addition of the superstrate may make it possible to increase the antenna gain without increasing the gain of the side lobes (side lobes are generally not desirable).

In summary, the proposed antenna system includes a cylindrical lens to focus the beam in the horizontal plane (azimuthal angle) and a superstrate to focus the beam in the vertical plane (elevation angle), in a flexible way since different heights of the superstrate lead to different elevation width.

The superstrate according to embodiments of the invention is in addition easy to manufacture by known manufacturing processes, inexpensive (low cost material) and easy to implement.

The superstrate (dielectric member) may be detachably mounted in the antenna system in order to add or remove the superstrate depending on whether or not the antenna gain should be modified.

The above examples are merely embodiments of the invention, which is not limited thereby.

The invention claimed is:

1. An antenna system comprising:

a cylindrical electromagnetic lens configured to guide at least one electromagnetic signal to an emerging area by means of at least a variation in dielectric permittivity, thereby generating a beam output from the emerging area;

a dielectric member configured to receive the beam output from the emerging area and to focus the beam in an elevation plane perpendicular to a planar face of the cylindrical electromagnetic lens, wherein the cylindrical electromagnetic lens is received in a conductive mounting, and said mounting carries said dielectric member.

2. An antenna system according to claim 1, wherein the dielectric member has a ring shape and surrounds at least partially the cylindrical electromagnetic lens, and wherein the dielectric member has a first external surface defined by a first cylinder having a first radius and a second external surface defined by a second cylinder having a second radius smaller than the first radius.

3. An antenna system according to claim 2, wherein the second external surface faces a lateral face of the cylindrical electromagnetic lens.

4. An antenna system according to claim 1, wherein the dielectric member has a height, in a direction parallel to the axis of the cylindrical lens, larger than a thickness of the cylindrical lens in said direction.

5. An antenna system according to claim 1, wherein the dielectric member is made of a material having a relative permittivity between 1.5 and 2.5.

6. An antenna system according to claim 1, including at least one radiating element situated on the circumference of the cylindrical electromagnetic lens and generating said electromagnetic signal, said radiating element including at least one waveguide.

7. An antenna system according to claim 6, wherein the cylindrical electromagnetic lens is received in a conductive mounting and wherein said radiating element is included in said conductive mounting.

8. An antenna system according to claim 7, wherein a circuit feeding the radiating element is mounted on the conductive mounting.

9. An antenna system according to claim 7, wherein a circuit feeding the radiating element is at least partly integrated in a substrate.

10. An antenna system according to claim 1, wherein said dielectric member is detachably mounted in the antenna system.

11. An antenna system according to claim 1, wherein the beam output from the dielectric member has, in an azimuthal plane perpendicular to the axis of the cylindrical electromagnetic lens, an angular width substantially equal to the angular width of the beam output from the cylindrical electromagnetic lens.

12. An antenna system according to claim 1, wherein the beam output from the cylindrical electromagnetic lens has a first angular width in the elevation plane and wherein the beam output from the dielectric member has a second angular width, smaller than the first angular width, in the elevation plane.

13. An antenna system according to claim 1, wherein the dielectric member has a variable height in a direction parallel to the axis of the cylindrical electromagnetic lens.

14. An antenna system according to claim 13, wherein the dielectric member has a ring shape with a variable height and surrounds at least partially the cylindrical electromagnetic lens, and wherein the dielectric member extends over at least a half circle arc in the azimuthal plane of the cylindrical electromagnetic lens, with the center of said circle being the center of the cylindrical electromagnetic lens.

15. An antenna system according to claim 14, wherein the half circle arc faces a lateral face of the cylindrical electromagnetic lens.

16. An antenna system according to claim 13, wherein the dielectric member comprises at least two symmetrical portions which are symmetrical with respect to an elevation plane comprising the axis of the cylindrical electromagnetic lens.

17. An antenna system according to claim 13, wherein the dielectric member comprises at least two portions which are not symmetrical with respect to an elevation plane comprising the axis of the cylindrical electromagnetic lens.

18. An antenna system according to claim 13, wherein the variation in height of the dielectric member is continuous along the edges.

19. An antenna system according to claim 13, wherein the variation in height of the dielectric member is discontinuous along the edges.

20. An antenna system according to claim 13, wherein the variation in height of the dielectric member is continuous along the edges of a portion of the dielectric member and discontinuous along the edges of the remaining portion.

21. An antenna system according to claim 13, wherein the dielectric member comprises at least two portions, each having a different constant height.

22. An antenna system according to claim 21, wherein the dielectric member comprises a central portion surrounded by two edges portions.

23. An antenna system according to claim 22, wherein the edge portions have the same height, different from the height of the central portion.

24. An antenna system according to claim 13, wherein the dielectric member comprises at least two parts, said at least two parts having different permittivity values.

25. An antenna system according to claim 13, wherein the dielectric member comprises at least two parts of different materials.

26. An antenna system according to claim 12, wherein said second angular width in the elevation plane depends on the angular direction of the beam input in the azimuthal plane of the cylindrical electromagnetic lens.

27. An antenna system according to claim 13, wherein said dielectric member is adjustable around the axis of the cylindrical electromagnetic lens.

28. A system comprising:

an antenna system according to claim 13, and at least two communication devices each able to communicate with said antenna system.

29. A system according to claim 28, wherein the dielectric member of the antenna system comprises as many portions as the number of communication devices, wherein at least two of said portions have different heights.

30. A system according to claim 29, wherein the height of each portion depends on the distance between the antenna system and the targeted communication device.

* * * * *